US007001238B1

(12) United States Patent
Gonzalez

(10) Patent No.: US 7,001,238 B1
(45) Date of Patent: Feb. 21, 2006

(54) CLAPPING APPARATUS

(76) Inventor: Manuel Gonzalez, 5201 Saratoga Dr. NW., Albuquerque, NM (US) 87120

( * ) Notice: Subject to any disclaimer, the term of this patent is extended or adjusted under 35 U.S.C. 154(b) by 0 days.

(21) Appl. No.: 10/461,135

(22) Filed: Jun. 13, 2003

Related U.S. Application Data

(60) Provisional application No. 60/388,809, filed on Jun. 13, 2002.

(51) Int. Cl.
*A63H 5/00* (2006.01)

(52) U.S. Cl. ..... 446/418; 446/397

(58) Field of Classification Search ..... 446/397, 446/418, 419, 420, 422, 176, 213, 215; 84/420, 84/411 P, 422.1, 422.2, 402, 418, 411 R, 84/442.3
See application file for complete search history.

(56) References Cited

U.S. PATENT DOCUMENTS

| | | | | | |
|---|---|---|---|---|---|
| 233,224 | A | * | 10/1880 | Flynt et al. | 482/82 |
| 385,002 | A | * | 6/1888 | Pagan | 446/422 |
| 1,647,795 | A | * | 11/1927 | Gladstone | 84/402 |
| 3,258,794 | A | * | 7/1966 | Goodwin et al. | 441/56 |
| 3,490,410 | A | * | 1/1970 | Crawford, Sr. | 116/67 R |
| 3,499,361 | A | * | 3/1970 | Harleman | 84/402 |
| 3,710,669 | A | * | 1/1973 | Jones | 84/402 |
| 3,730,047 | A | * | 5/1973 | Casavant | 84/402 |
| 3,859,886 | A | | 1/1975 | Brisco, Sr. | |
| 3,902,256 | A | * | 9/1975 | Liu | 434/340 |
| 3,994,078 | A | * | 11/1976 | Liu | 434/335 |
| 4,150,602 | A | * | 4/1979 | Santiago, Sr. | 84/402 |
| 4,248,129 | A | * | 2/1981 | Zildjian | 84/422.1 |
| 4,513,035 | A | | 4/1985 | Barfield et al. | |
| 4,658,694 | A | * | 4/1987 | Marks et al. | 84/402 |
| 4,787,876 | A | * | 11/1988 | Nguyen et al. | 446/408 |
| D323,861 | S | * | 2/1992 | Cooper | D21/405 |
| D372,744 | S | | 8/1996 | Potzuski | |
| D385,904 | S | | 11/1997 | Kim | |
| D399,269 | S | | 10/1998 | Bishop, Jr. | |
| 5,873,766 | A | | 2/1999 | Burton | |
| 5,975,008 | A | | 11/1999 | Malta | |
| 5,984,761 | A | | 11/1999 | Kalinowski | |
| 6,006,939 | A | * | 12/1999 | Wai | 220/203.05 |
| 6,108,817 | A | | 8/2000 | Kostelac | |
| 6,307,193 | B1 | * | 10/2001 | Toole | 219/735 |

FOREIGN PATENT DOCUMENTS

DE 19727105 A1 * 1/1999

OTHER PUBLICATIONS

Internet Site, www.geeyung.com, Oct. 2001, pp. 1-2.*

* cited by examiner

*Primary Examiner*—Bena Miller
(74) *Attorney, Agent, or Firm*—Rod D. Baker; Peacock Myers, P.C.

(57) ABSTRACT

A clapping apparatus preferably having a knob like handle securely fastened to a clapping plate. The clapping plate preferably having a recessed area with air holes placed though the clapping plate enabling air to fill the void created when two contacting clapping plates are rapidly pulled away from one another.

5 Claims, 3 Drawing Sheets

CLAPPING APPARATUS

CROSS-REFERENCE TO RELATED APPLICATIONS

This application claims the benefit of the filing of U.S. Provisional Patent Application Ser. No. 60/388,809, entitled "Applause Device", filed on Jun. 13, 2002, and the specification thereof is incorporated herein by reference.

BACKGROUND OF THE INVENTION

1. Field of the Invention (Technical Field)

The present invention relates generally to noise making devices, and more particularly to devices that mimic the sound of applause.

2. Description of Related Art

Discussion of the publication herein is given for more complete background and is not to be construed as an admission that such publication is prior art for the patentability determination purposes.

In a wide variety of sporting, musical, and other entertainment events, such as football games, live theatrical productions, and musical concerts, a major source of enjoyment for the spectators is their ability to show their appreciation and pleasure for the performance of the athletes or musicians. At such events, the spectators often wish not only to show their appreciation, but also to inspire other spectators to do the same. Creating loud sounds such as applause, whistling, yelling and stomping inspires other spectators to increase the volume of their appreciation. Magnifying the sound of applause shows greater appreciation for the athletes or other performers. One conventional method of response by the audience is applause, which is created by clapping two hands together.

In large arenas, especially in outdoor stadiums, amphitheaters, racetracks and the like, magnifying the applause sound requires vigorous clapping. Vigorous and prolonged clapping can lead to several problems. A lengthy event with many occasions for applause may cause stinging sensations in the palms of audience members. Numerous occasions of applause may lead to fatigue of the arms and hands so that the applause becomes less consistent and less enthusiastic during the latter part of the event. Low temperatures and other weather conditions may encourage the use of gloves which in turn makes ordinary hand clapping inadequate or ineffective. Some forms of noisemakers (horns, rattles and the like) may be inappropriate, unacceptable, awkward, clumsy, too large, or prohibited by the event management.

Noisemakers currently in use do not remove the problem of stinging palms caused by clapping. For example, U.S. Pat. No. 3,490,410, issued Jan. 20, 1970 to Crawford describes clapping "mittens" that fit onto the user's hands. The user's hands fit between the clapper surface and an elastic band which secures the mittens onto the user's hands. The user claps his hands together, which causes the mittens to come together creating a loud sound. However, since the users hands are still brought together in an open position with palms facing inward, this invention will still cause the user's hands to sting, possibly even more so than if only the clapper's hands were used to create applause. To alleviate the pain and fatigue, Crawford discloses that padding can be placed between the user's hand and the clapping surface. The use of padding, however, has the undesirable attribute of absorbing the impact of the two surfaces, thus creating dampening effect. Due to the unique position of the user's hands during the operation of the present invention, the need for padding to prevent pain and fatigue is eliminated. Since the user grasps the knob of the present invention with his fingers, the harsh effect of a hard object impacting the palm of the hand is avoided.

BRIEF SUMMARY OF THE INVENTION

The present invention is directed to applause apparatuses, more particularly to applause apparatuses that can be held in the gloved hands of the user. The clapping apparatus comprises a clapping plate and a knob that is rigidly secured to the clapping plate. It is preferable to have a recessed area on one or both of the clapping plates of the clapping apparatus. It is also preferable to dispose one or more holes in the clapping plate of the apparatus to enable air to pass though the holes and fill the void created when the clapping plates are rapidly pulled apart. The one or more holes are preferably disposed in the clapping plate at the location of the recessed area.

If two or more of the clapping apparatuses are to be transported or stored, it is possible to secure them together with a substantially ridged material such as a metallic material, or a plastic. It is also possible to secure the two apparatuses together with a flexible material such as a cord, thong, rope, line, tether, string, chain, etc.

The present invention also relates to a method for generating a simulated clapping sound. To achieve a simulated clapping sound the user places a first clapping apparatus in one hand and a second clapping apparatus in the other hand. The clapping apparatus are then struck together, preferably in rapid succession. As above, it is preferred that the clapping apparatuses have a recessed area on their clapping plates with holes placed through the clapping plate within the recessed area.

A primary advantage of the present invention is that a more effective way for people to clap under various circumstances and conditions is created. Another advantage of the present invention is that pain and fatigue associated with clapping is eliminated.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The applause apparatus of the present invention solves the problems created by prolonged and vigorous clapping of hands when creating applause.

The term "knob" as used throughout the specification and claims is meant to mean any handle element adapted to be comfortably grasped in the hand. It is noted that the apparatus of the invention may be fashioned in more than one size, e.g., smaller embodiments may be made for use by children. It also is noted that the invention may be manufactured for purchase by the user, or could be the object of a short-term rental at the performance event. Advertising messages could be affixed to the apparatus.

Figure 1:
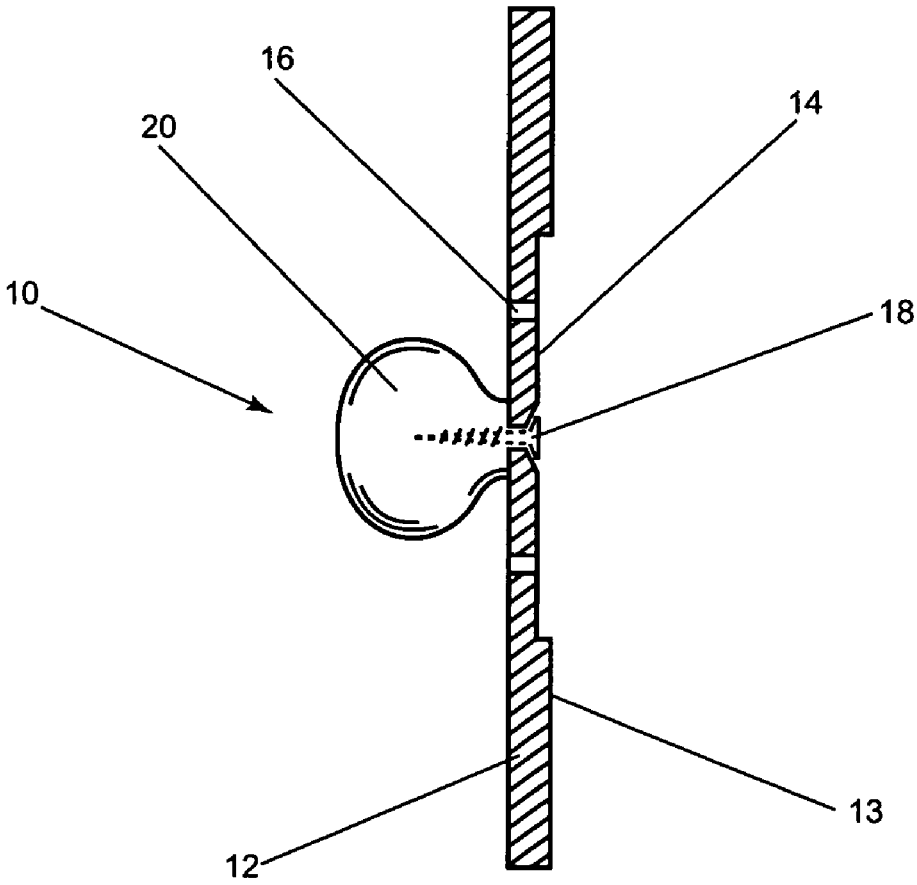
FIG. 1 is sectional view of the clapping apparatus of the present invention.

The preferred embodiment of the present invention uses two clapping apparatus to achieve its objective. FIG. 1 shows a sectional view of the preferred embodiment for a single clapping apparatus 10 of the present invention. Description of one clapping apparatus 10 serves to describe either of a pair, and ordinarily the inventive apparatus is used in pairs. Clapping apparatus 10 consists of clapping plate 12 having a striking surface 13 defining a recessed area 14, and with air holes 16 therein. A knob 20 is securely fastened to the back side of the clapping plate 12 in any suitable way, such as by gluing; preferably, a screw 18 is used to fasten knob 20 to clapping plate 12 through a hole in the center of clapping plate 12. Knob 20 enables the operator to grasp the clapping apparatus with the fingers of one hand and bring the striking surface 13 of clapping plate 12 into abrupt contact with the striking surface 13 of another (e.g., identical) clapping apparatus 10, which is held in the user's opposite hand.

Figure 2:
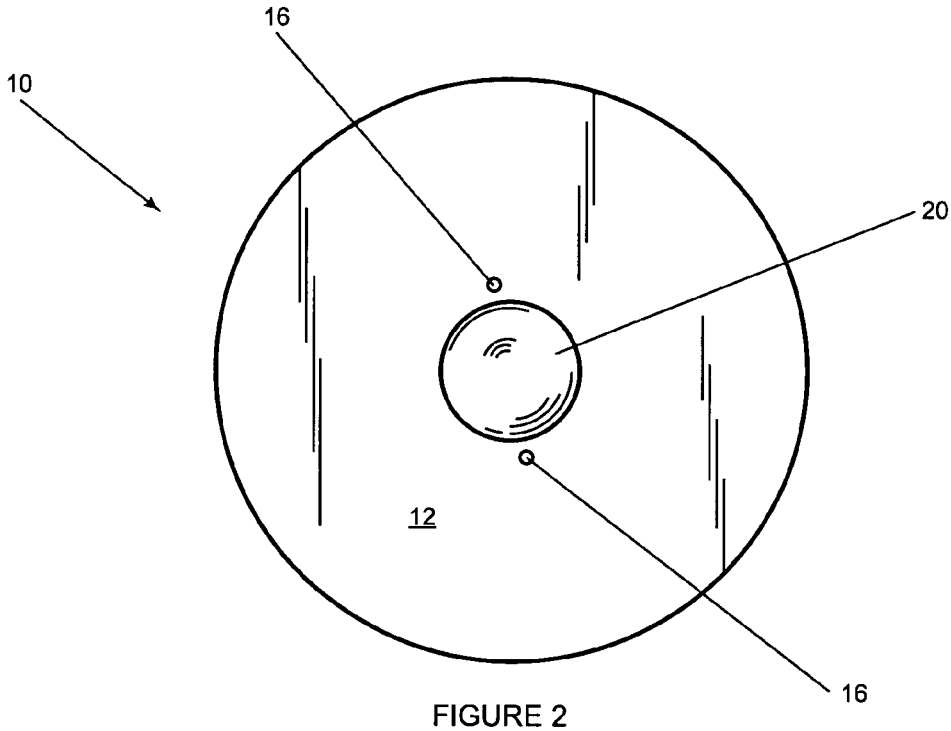
FIG. 2 is a top view of the clapping apparatus.
Figure 3:
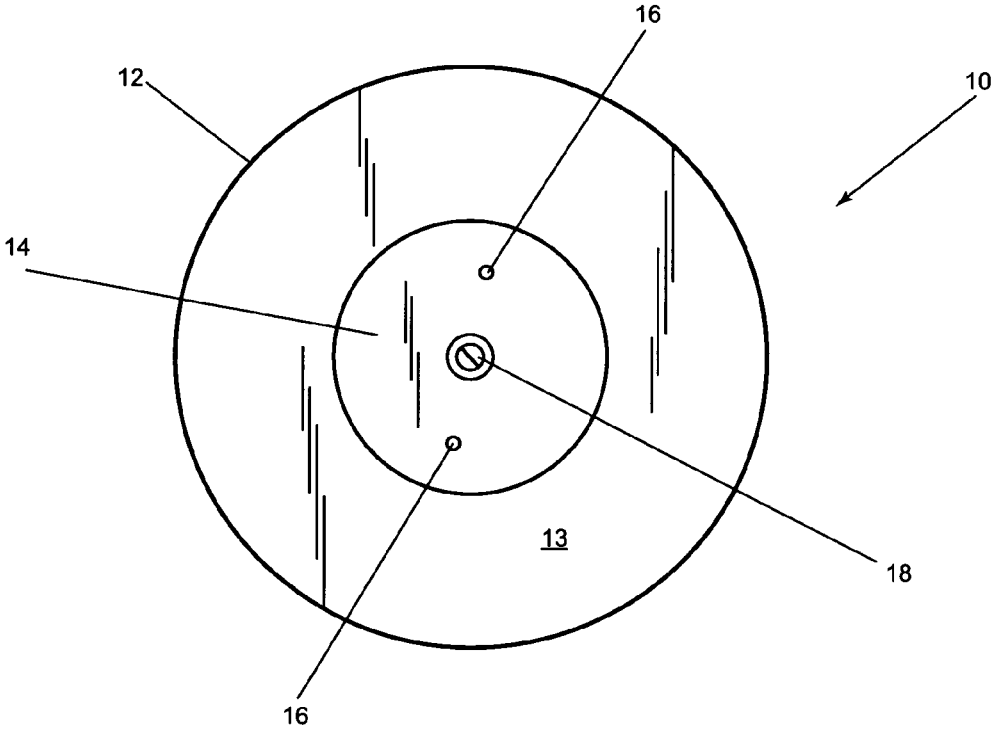
FIG. 3 is a bottom view of the apparatus.

Clapping plate 12 of the present invention can be made of any hard material such as high impact styrene, wood, metal, or plastic. The clapper plate 12 is substantially rigid and planar. The plate 12 vibrates when stricken only enough to produce a smart snapping, clacking or cracking sound; its lack of flexibility precludes the generation of any prolonged reverberation or vibrato sounds, such as the lingering crash of the cymbals in the percussion section of a musical band. FIGS. 2 and 3 are illustrative views of the preferred embodiment of the present invention. A disc, for example from about three to about seven inches in diameter, may be made of Plexiglas® plastic, which is a preferred composition for clapping plate 12 of the present invention. The material for clapping plate 12 can be clear or colored and can have decals or printing placed upon them for advertising purposes. The recessed area 14 is a circular recession defined in the face of the striking surface 13. The recessed area 14 is only slightly depressed, e.g. 1/16 inch to 1/8 inch, relative to the surrounding outer portion of the striking surface 13. The provision of the recessed area 14 promotes vibration of the clapping plate 12 and thus enhances the sound-making capacity of the invention.

Knob 20 is preferably made of wood and is preferably in a rounded shape, however, it can be made of another suitable material, such as plastic or metal, and can be shaped as any other handle known in the art. Further, the knob 20 alternatively may be integrally molded with the clapping plate 12. Clapping plate 12 can be smaller or larger than 4 inches in diameter without substantially compromising the volume of the sound produced. The thickness of clapping plate 12 is preferably about three-sixteenths of an inch; however, other thickness can achieve the same or similar resultant sound. The inner or striking surface 13 of each disc-shaped plate 12 preferably features, at its central portion, a generally circular recessed area 14 of between about two and about three inches diameter, which increases the volume of the sound produced when the two clapping plates are clapped together.

There is a tendency for a slight vacuum to be created when two substantially flat planar surfaces are abruptly slammed together, as during the practice of the invention. The vacuum between the plates 12 results in an ambient air pressure tending to hold the plates together in flush contact for a brief instant. While this vacuum is easily broken by the user's pulling the plates 12 back apart, the vacuum and the resulting short pause before plate separation can dampen the noise making effect. The more rapidly the plates 12 can be pulled apart, the sooner they are freed to vibrate independently of each other to generate the desired clapping sound.

It is desirable, therefore to ameliorate this vacuum effect which causes two clapping apparatuses to very briefly "stick together" during clapping. To decrease this vacuum effect, one or more air holes 16 preferably are provided through clapping plate 12 of each clapping apparatus 10. Preferably, a plurality of air holes is provided in a symmetrical array around the center of the plate 12, and within the recessed area 14. Each air hole 16 extends through and is arranged orthogonally to clapping plate 12. In one preferred embodiment, each hole is situated approximately one-eighth to one-quarter of an inch radially inward from the outer circumference of the recessed area 14 of clapping plate 12. The diameter of each air hole 16 is preferably about one-sixteenth of an inch. Although the configuration of the air passageways shown in the figures has been found to alleviate the vacuum, the number, location, shape, diameter and angle of air holes 16 on clapping plate 12, can be varied while maintaining the objective of the present invention.

The entire clapping apparatus of the present invention can be made from a single continuous piece of material. For example a knob and clapping plate, with or without a recess and holes, can be formed through techniques such as but not limited to injection molding or milling.

To use the present invention the user grasps knob 20 of one clapping apparatus 10 and strikes the striking surface 13 of one clapping plate 12, preferably in rapid succession, against the striking surface 13 of the clapping plate 12 of a second clapping apparatus 10. The second clapping apparatus is preferably controlled by the user's opposing hand grasping knob 20 of the second clapping apparatus 10. This creates a loud sound similar to applause and can be achieved even when the user has gloved hands. Use of the present invention in place of traditional applause allows the user to create a loud clapping sound without causing a stinging sensation to the user's hands. This allows the user to clap vigorously for prolonged periods of time without pain or fatigue.

Figure 4:
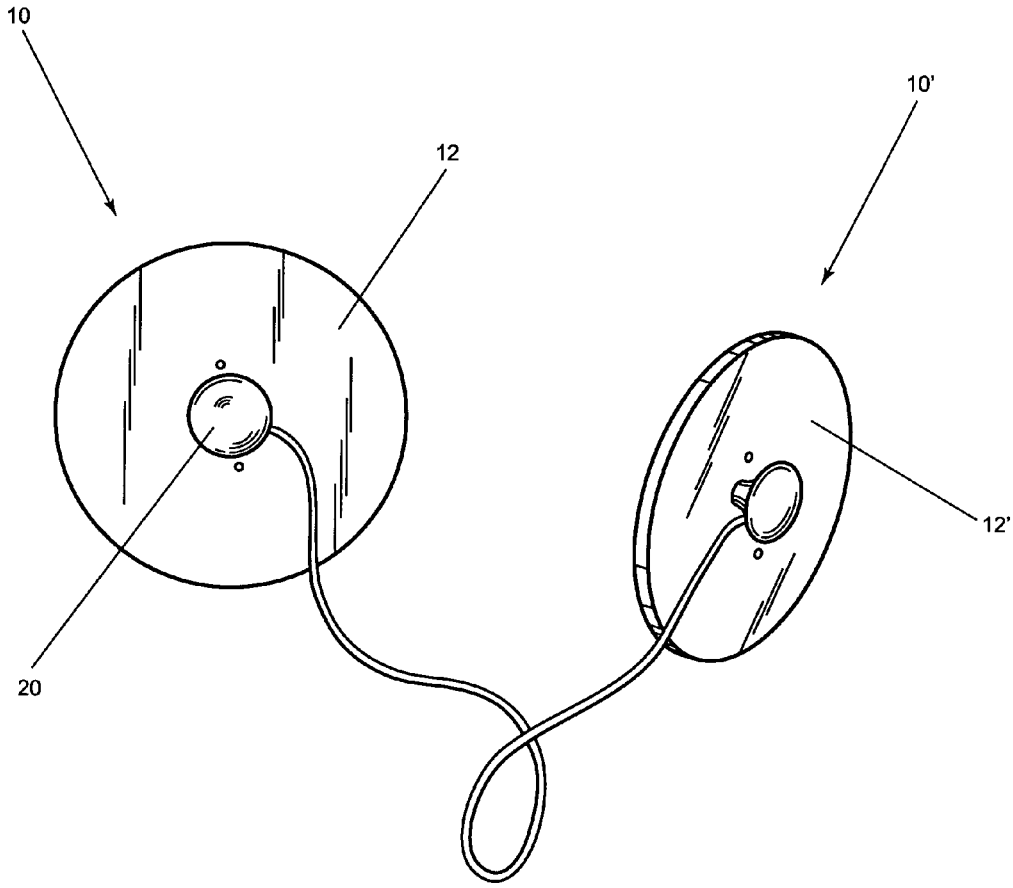
FIG. 4 is a view of a pair of clapping apparatus as may be positioned for use.

FIG. 4 illustrates that the invention is preferably is used and may be marketed in pairs, with a flexible cord for physically coupling the apparatuses to one another. A pair of clapping apparatuses 10, 10' optionally may be retained as a pair by the use of a cord or ribbon 24 connected to each apparatus 10, 10', the points of connection preferably being on the knobs so as not to interfere with the noise-making function of the clapper plates 12, 12'.

The method of the invention is apparent from the foregoing description of the apparatus. An advantage is that in the method, the quick breaking of the induced vacuum between the clapping plates allows for a louder clap. The method, in short, features the steps of (1) disposing a first clapping apparatus in a first hand; (2) disposing a second clapping apparatus in a second hand; (3) defining at least one hole through each of the clapping apparatuses; (4) providing mutually contactable striking surfaces on each of the clapping apparatuses, each striking surface having a recessed area at a substantially central portion of the mutually contactable surface; (5) striking the striking surface of first clapping apparatus against the striking surface of the second clapping apparatus; and (6) rapidly separating the striking surfaces.

The preferred embodiment of the present invention can fit into an average size purse or pocket when not in use. A cord or chain connecting the two discs can be used to prevent the loss of one disc, and to allow the user to drape the apparatus around his neck when not in use.

The present invention can also be used as to aid in warding animals away such as bears and dogs.

Although the invention has been described in detail with particular reference to this preferred embodiment, other embodiments can achieve the same results. Variations and modifications of the present invention will be obvious to those skilled in the art and the invention is intended to cover all such modifications and equivalents.

What is claimed is:

1. A clapping apparatus comprising:

a clapping plate comprising a planar striking surface and a planar back side;

a planar area defined centrally in and recessed below said planar striking surface;

at least one air hole disposed in said recessed planar area and completely penetrating orthogonally through said clapping plate; and a knob secured to said planar backside of said clapping plate.

2. The clapping apparatus of claim 1 further comprising a plurality of air holes penetrating orthogonally through said clapping plate.

3. The clapping apparatus of claim 1 further comprising a second clapping apparatus according to claim 1.

4. The clapping apparatus of claim 3 further comprising a flexible cord for physically coupling said clapping apparatuses to one another.

5. A method for generating a simulated clapping sound, the method comprising the steps of:

disposing a first clapping apparatus in a first hand;

disposing a second clapping apparatus in a second hand;

providing mutually contactable planar striking surfaces on each of the clapping apparatuses, each striking surface having a recessed planar area at a substantially central portion of the mutually contactable planar surface;

defining at least one hole through each of the clapping apparatuses within said recessed area;

striking the planar striking surface of first clapping apparatus against the planar striking surface of the second clapping apparatus; and rapidly separating the striking surfaces.

* * * * *